United States Patent [19]

Poll

[11] Patent Number: 4,981,548

[45] Date of Patent: Jan. 1, 1991

[54] APPARATUS FOR USE IN REMOVING TILE FROM A FLOOR

[76] Inventor: Elmer J. Poll, P.O. Box 124, Conway, Mo. 65632

[21] Appl. No.: 433,324

[22] Filed: Nov. 8, 1989

[51] Int. Cl.[5] ..... B32B 31/18

[52] U.S. Cl. ..... 156/584; 156/344; 156/499; 219/201; 299/36

[58] Field of Search ..... 156/344, 584, 499; 219/201, 228; 299/36

[56] References Cited

U.S. PATENT DOCUMENTS

| | | | |
|---|---|---|---|
| 1,681,104 | 10/1925 | Earnhardt . | |
| 2,612,586 | 5/1949 | Berarducci | 219/21 |
| 2,655,976 | 1/1951 | Lovin | 156/584 |
| 3,400,244 | 5/1965 | Meltzer | 219/228 |
| 3,619,557 | 11/1971 | McClure | 219/228 |

OTHER PUBLICATIONS

Manufacturer: Aerospace America, Inc., Title: Aero-Tilelift, Magazine: ECON Environmental Contractor, Date: Aug. 1989, p. 44.

*Primary Examiner*—Robert A. Dawson

*Attorney, Agent, or Firm*—Senniger, Powers, Leavitt & Roedel

[57] ABSTRACT

Apparatus for use in removing tile from a floor, the apparatus including a generally horizontally extending frame having a front end, a rear end and laterally opposing sides. Wheels are attached to the frame for rolling the frame across the floor, and a handle is mounted on the frame to steer it. Burner units mounted on the frame heat tiles below the burner units to loosen the tiles from mastic adhering the tiles to the floor. A tank mounted on the frame stores fuel for the burner units and a delivery system transports fuel from the tank to the burner units. A blade attached to the frame separates the heated tile from the floor as the frame moves across the floor.

20 Claims, 4 Drawing Sheets

FIG. 3.
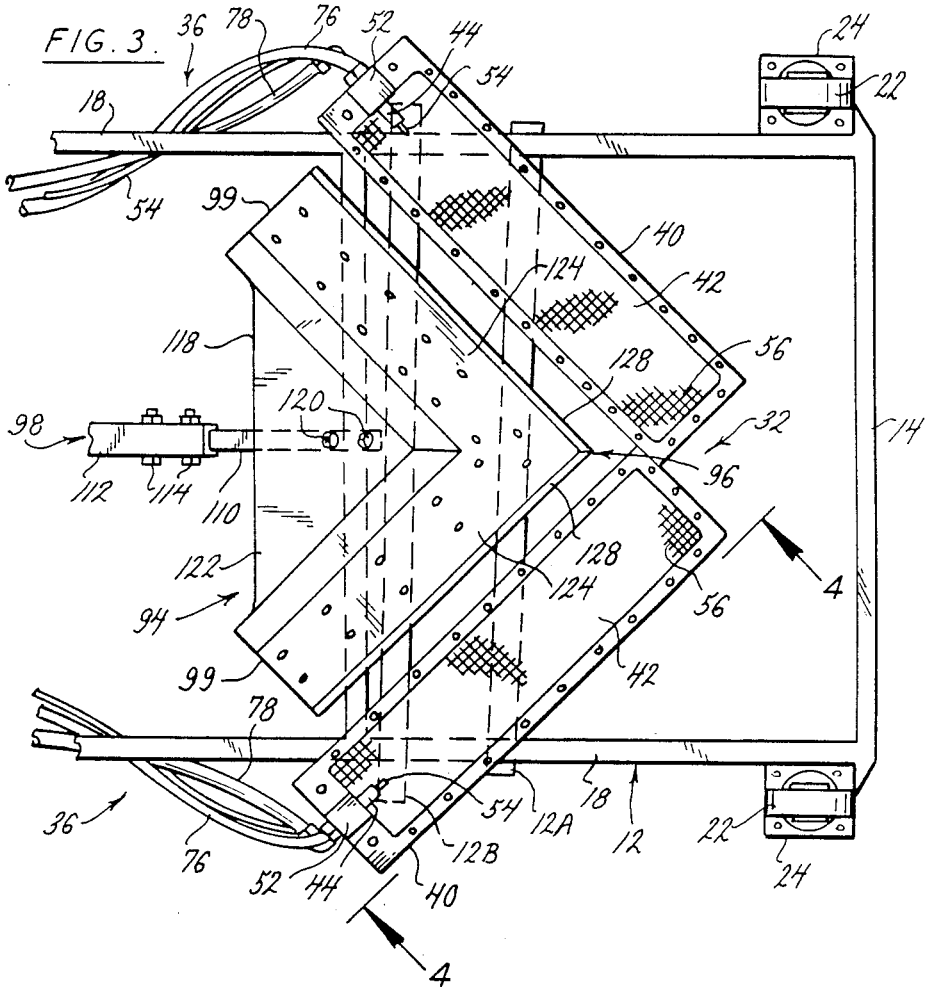
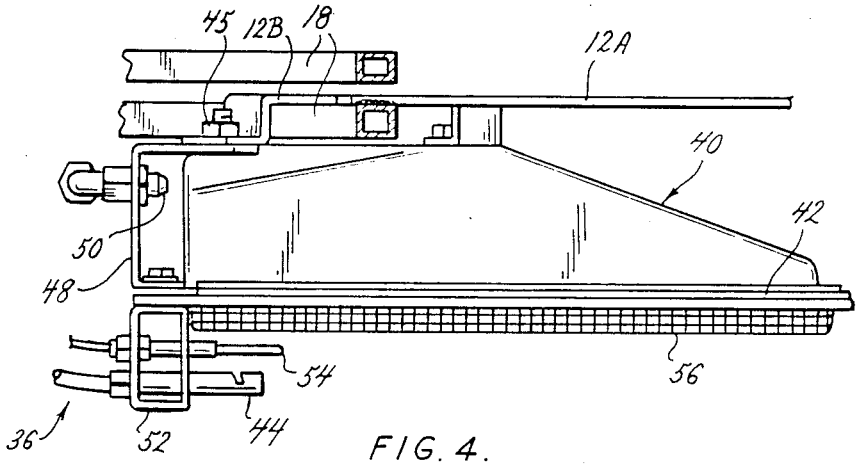
FIG. 4.

APPARATUS FOR USE IN REMOVING TILE FROM A FLOOR

BACKGROUND OF THE INVENTION

This invention relates generally to apparatus for use in removing tile from a floor and more particularly to apparatus which applies heat to the tiles and the floor to loosen the tiles for removal.

The removal of tile from a floor is greatly facilitated by the application of heat to the tile, to the floor, and particularly to the mastic adhering the tile to the floor. Typically, tile which has been subjected to heat may be removed from the floor without breaking. This is of particular advantage in reducing or eliminating dust from broken tiles, which is important when the tiles being removed contain asbestos. The reduction of asbestos dust during tile removal reduces exposure to the operators and allows a very significant cost savings in that the room does not have to be sealed from dust during the operation.

Reference is made to U.S. Pat. No. 3,400,244 which shows an example of an apparatus for heating floor tiles to facilitate their removal. Currently, tile heating machines are dependent on a cord connected to an electrical outlet for power. The cord extending from the outlet to the machine limits the range of the machine. It is also difficult to manipulate the cord while using the machine to avoid dragging in the sticky mastic exposed after removal of some of the tile. Because of the high voltage required to operate electric heaters at sufficiently high temperatures to loosen the tiles, an ordinary electrical outlet will not be sufficient and the machine must be hard-wired into the building's electrical system. Therefore, considerable effort will be expended merely in preparation for using the machine. Further, when using the current available tile loosening machines, a tool such as a spatula type instrument must be used to manually remove the tile from the floor after it is loosened.

SUMMARY OF THE INVENTION

Among the several objects of this invention may be noted the provision of apparatus for use in removing tile from a floor which removes the tile without breaking the tile; the provision of such apparatus which is mobile and free of umbilical connection to a remote energy source; the provision of such apparatus which both loosens and removes the tile from a floor; the provision of such apparatus which is self-contained; and the provision of such apparatus which is easy to operate.

Generally, the apparatus for use in removing tile from a floor of the present invention comprises a generally horizontally extending frame having a front end, a rear end, and laterally opposite sides. Roller means attached to the frame allow the frame to be rolled across the floor, and a handle mounted on the frame facilitates steering the frame over the floor. Heater means mounted on the frame heats tiles generally located below it to loosen the tiles from mastic adhering the tiles to the floor. Means for storing fuel for the heater means is mounted on the frame and self-contained on board the frame. Means is provided for delivering the fuel from the storing means to the heater means. The fuel delivery means is also self-contained on board the frame. The apparatus is thus able to be moved about the floor to remove tile therefrom without connection to an energy supply remote from the apparatus, eliminating the difficulties encountered in making such connections and handling the cord, and making the apparatus easier to control in use. Means mounted on the frame wedges between the floor and tile loosened from the mastic by the heater means for separating the tile from the floor as the frame is moved over the floor.

Other objects and features will be in part apparent and in part pointed out hereinafter.

BRIEF DESCRIPTION OF THE DRAWINGS

FIG. 3 is a bottom plan of the front portion of the frame;

FIG. 4 is an elevation of a gas burner of the apparatus viewed as indicated by line 4—4 of FIG. 3;

Corresponding reference characters indicate corresponding parts throughout the several views of the drawings.

DETAILED DESCRIPTION OF A PREFERRED EMBODIMENT

Figure 1:
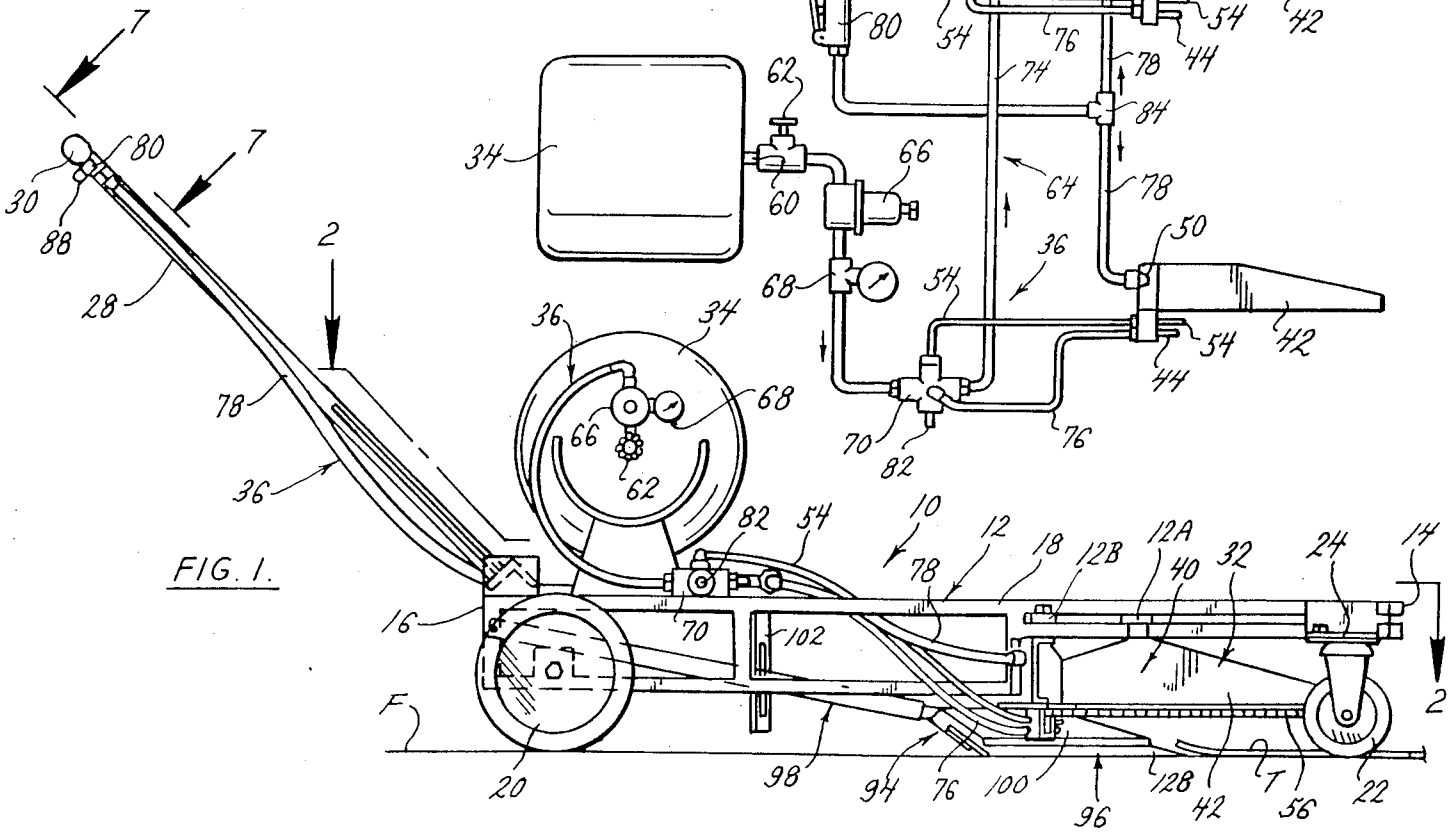
FIG. 1 is an elevation of apparatus constructed according to the principles of the present invention.
Figure 2:
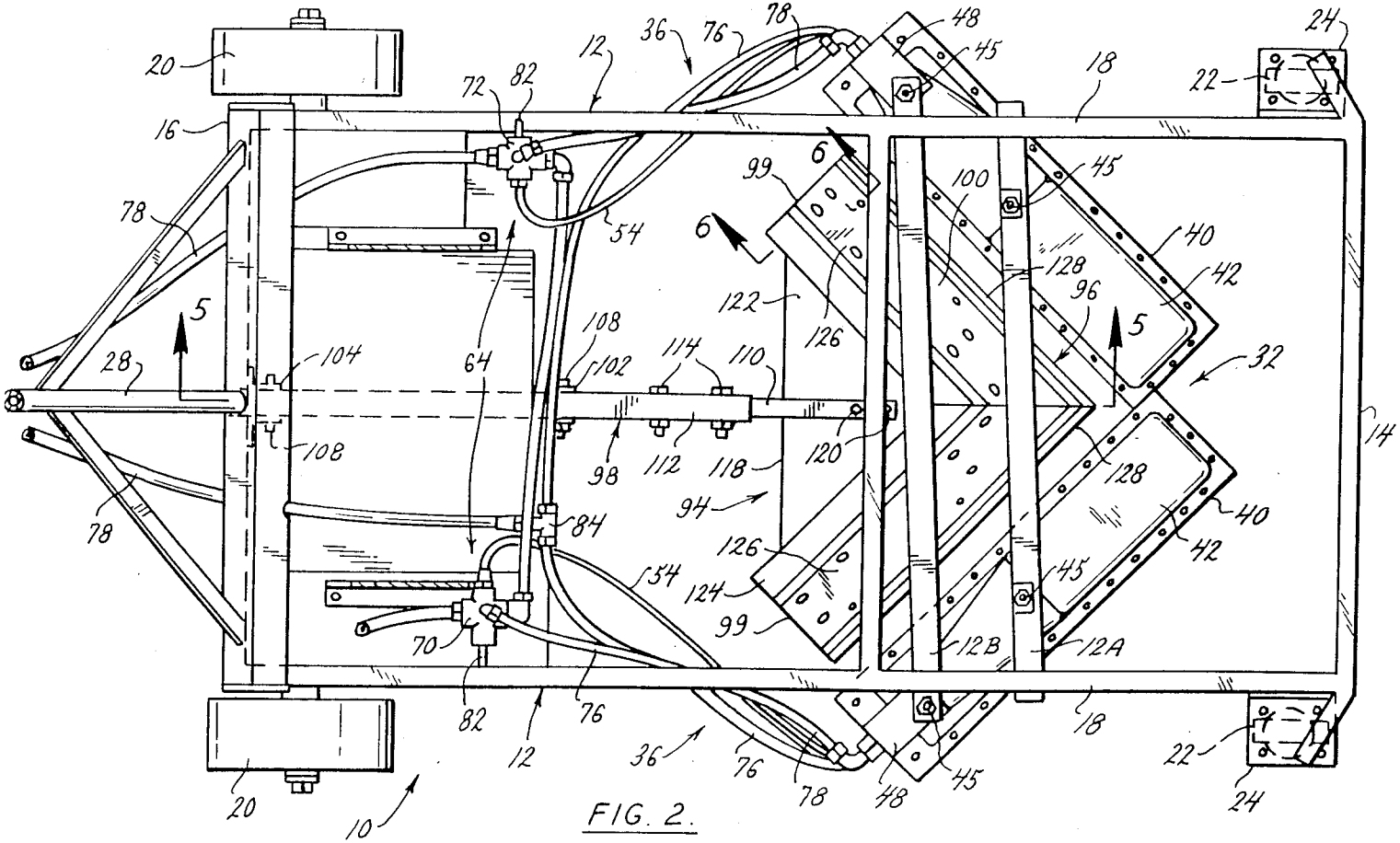
FIG. 2 is a top plan of the frame as indicated by line 2—2 of FIG. 1.
Figure 5:
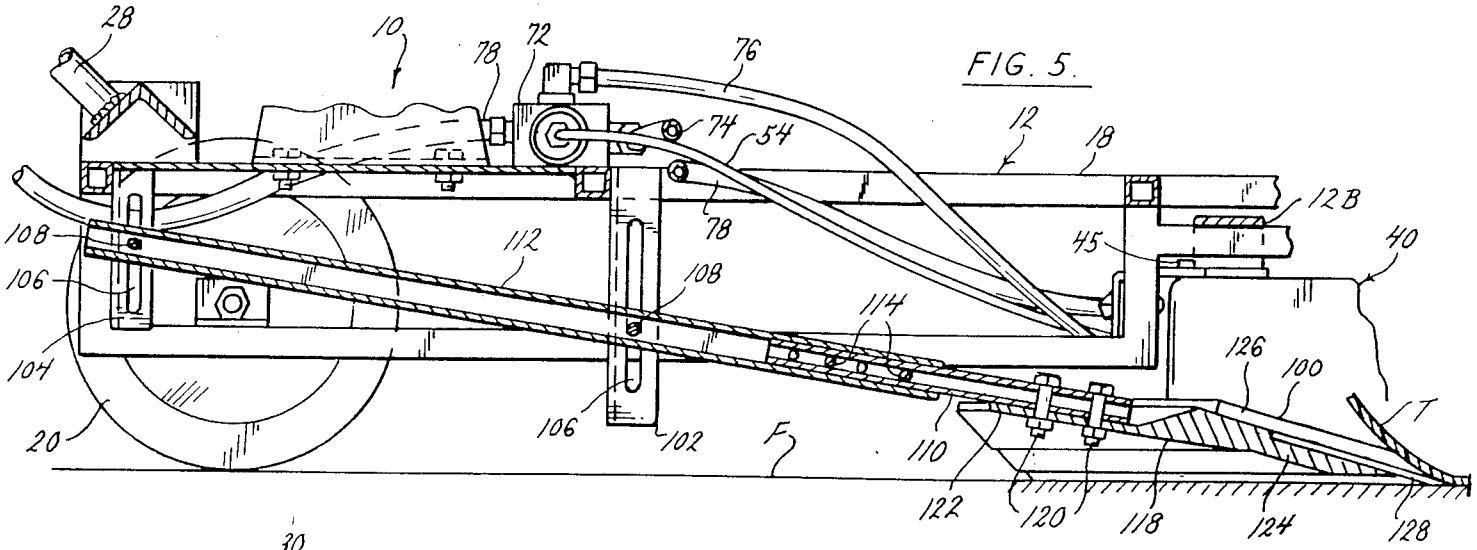
FIG. 5 is a horizontal section of the apparatus taken in the plane including line 5—5 of FIG. 2.

Referring now to the drawings, and particularly FIG. 1, 2, and 5, apparatus constructed according to the principles of this invention for use in removing tile T from a floor F, is indicated generally a 10. The apparatus comprises a generally horizontally extending, rectangular frame 12 having a front end 14, a rear end 16 and laterally opposing sides 18. Roller means, such as rear wheels 20 and front wheels 22, are attached to the frame 12 so that the frame can be rolled over the floor from which tile is to be removed. The front wheels 22 are mounted on brackets 24 fixed to the frame 12 and may pivot about a vertical axis to aid in steering the frame over the floor. A handle, indicated in its entirety by 28, is mounted on the rear end 16 of the frame and projects upwardly and rearwardly from the rear end. The operator of the apparatus 10 may propel and steer the frame 12 across the floor by grasping hand grips 30 projecting laterally outwardly from the handle 28 at its distal end while walking behind the frame. Heater means, generally indicated at 32, mounted on the frame 12 near the front end 14, heats tiles T located generally under the frame to loosen them from the mastic adhering them to the floor F. A tank 34, mounted on the frame 12 generally adjacent the rear end 16, stores fuel for the heater means 32 and is self-contained on board the frame. Fuel is delivered from the tank 34 to the heater means 32 through conduit means indicated generally at 36.

The provision of the heater means 32, tank 34, and conduit means 36 entirely self-contained on board the frame 12 allows the apParatus 10 to be moved freely about the floor F to remove tile T from the floor without connection to a fuel supply remote from the apparatus. The lack of an umbilical, such as an electric cord, connected to a remote energy source increases the range of the apparatus and eliminates the problems encountered with cords such as damaging the cord or fouling it with exposed mastic.

The heater means 32 comprises, in this preferred embodiment, two burner units indicated in their entireties by 40. It is to be understood that the number of gas burner units 40 is not critical to the invention. The tank 34 is preferably of the type which stores gas under pressure to fuel the burner units 40. The conduit means 36 extends from the tank 34 to each gas burner unit 40. As shown in FIG. 4, each burner unit 40 has a burner 42 and a pilot 44. Each burner unit is mounted on cross members 12A, 12B of the frame 12 by fasteners 45 so that it faces generally downwardly. A first bracket 48, also mounted on the frame 12, supports a nozzle 50 of the burner attached to the conduit means 36. Gas is fed through the nozzle 50 into the burner 42 through an opening (not shown) in the burner. A second bracket 52 attached to the burner 42 holds the pilot 44, which is connected to the conduit means 36. The second bracket 52 also supports a thermocouple 54 for sensing absence of a pilot flame and triggering a shut-off of gas to the pilot. A heavy screen 56 attached to the bottom of the burner 42 protects the radiant surface (not shown) of the burner. The burners 42 are of the infrared type, capable of supplying a high level of radiant heat to the floor F to soften the mastic without exposure of the burner flame outside the burner 42 which could be hazardous and could damage the tile during heating.

Figure 8:
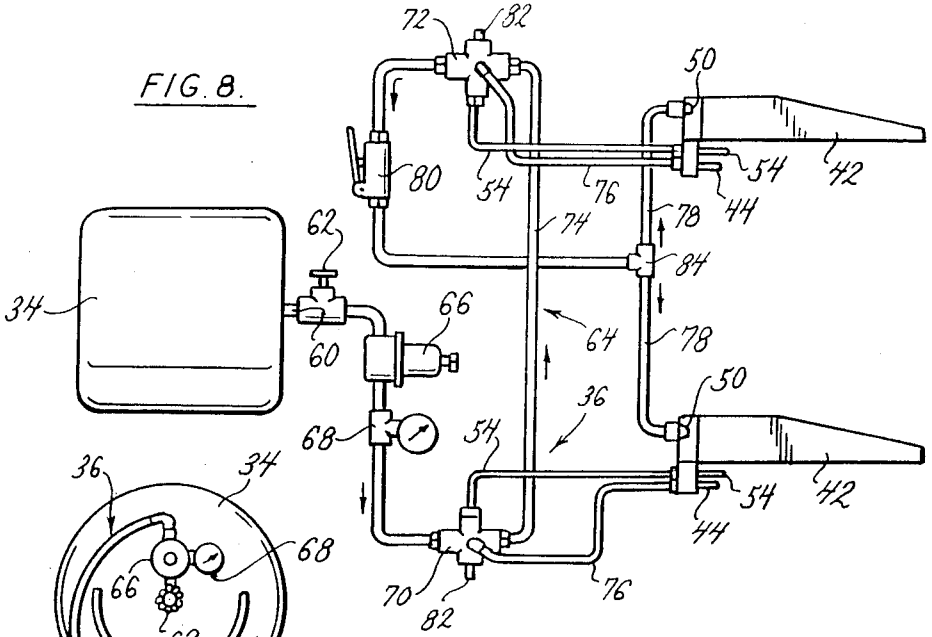
FIG. 8 is a schematic of the gas supply system.

Referring now to FIG. 8. which is a schematic of the fuel delivery system of the apparatus 10, it can be seen that the tank 34 has an outlet 60 to which the conduit means 36 is connected, and a valve 62 for opening and closing the outlet. A portion of the conduit means 36 extends from the tank outlet 60 to manifold means, indicated generally at 64, and includes a regulator 66 and pressure gauge 68. The manifold means 64 includes a first manifold 70 and a second manifold 72 connected to the first by a pipe 74. First tubing 76 extends from each of the manifolds 70, 72 to each of the pilots 44 and second tubing 78 extends from the second manifold 72 to each of the burners 42. Control means, constituting in this embodiment a valve assembly indicated generally at 80, is interconnected with the second tubing 78 for controlling the flow of gas from the tank 34 to the burners 42. Arrows in FIG. 8 indicate the flow of gas from the tank 34 to each of the burners 42. Upon reaching the first manifold 70, some of the gas may flow through the first tubing 76 to the pilot 44 of the right burner unit 40 while the rest continues from the first manifold through the pipe 74 to the second manifold 72. There, a portion of the gas may be diverted to the pilot 44 of the left burner unit 40 and the remainder passes into the second tubing 78. Flow of gas from each manifold through the first tubing 76 to the respective pilots 44 is controlled by a button 82 on the manifold. The gas flows through the second tubing 78 and valve assembly 80 to a T-connection 84 where the second tubing splits as gas is fed to the individual burners 42.

Figure 7:
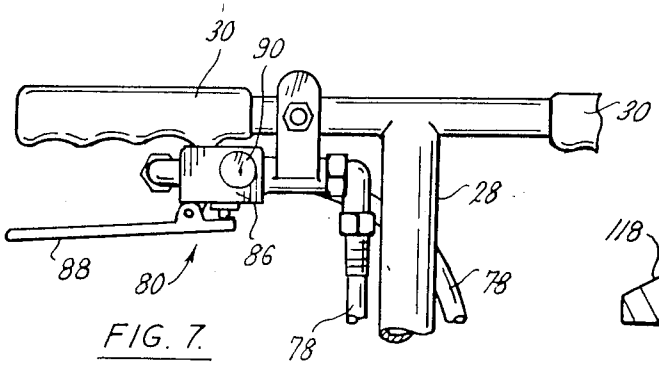
FIG. 7 is an elevation of the handle showing the valve assembly viewed as indicated by line 7—7 of FIG. 1.

The valve assembly 80, as best seen in FIG. 7, includes a body 86 and means, comprising lever 88, for actuating the valve assembly to control the flow of gas to the burners 42. The lever 88 is adapted to be moved from a first position, in which the valve assembly 80 stops the flow of gas from the tank 34 to the burners 42, toward the left hand grip 30 to a second position in which the valve assembly permits gas to flow from the tank to the burners. The lever 88 is located adjacent the left hand grip 30 (FIG. 7) so that it may be conveniently manipulated by the operator without releasing the hand grips. A knob 90 on the body 86 of the valve assembly 80 may be turned to control the rate of gas flow through the valve assembly to provide a course adjustment of the heat output of the burners 42. In this preferred embodiment, the entire valve assembly 80 can be mounted on the handle 28 adjacent the left hand grip 30. However, it is also within the scope of this invention to have the not the lever 88 located adjacent the handle 28 with a remote actuation connection between the lever and body 86 of the valve assembly 80, which can be located elsewhere on the frame 12. The lever 88 is biased toward its first position so that gas will only be supplied to the burners 42 when the operator holds the lever in the second position. This "dead man" feature conserves gas and aids in preventing the operator from becoming burned should he have cause be near the burners 42 during the tile removal procedure.

Wedging means, generally indicated at 94, is mounted on and depends from the frame 12 for wedging between the floor F and tiles T loosened from the mastic by the burners 42 to separate the tiles from the floor as the frame is moved across the floor. As best seen in FIG. 2, the wedging means 94 comprises a generally laterally extending blade, indicated generally at 96, which is disposed rearwardly of the burner units 40 and a blade support 98 attaching the blade to the frame 12. The blade 96 has laterally outer ends 99 and a generally forwardly facing inclined surface 100 for wedging between tiles and the floor to lift the tiles from the floor. The forwardly facing surface 100 is inclined at an angle of approximately 15 degrees from the horizontal so that the tile is gradually lifted from the floor as the frame 12 passes in a forward direction. It is to be understood that the exact angle of incline is not critical. The blade support 98 is adapted to adjustably position the blade 96 in a front to rear direction and in a vertical direction relative to the frame 12. The blade support 98 is slidably connected to a front bracket 102 and a rear bracket 104, each having a vertically extending slot 106 therein and depending from the frame 12. The blade 96 may be adjusted in the vertical direction by loosening fasteners 108 and sliding the blade support 98 up or down in the slots 106 to the desired height. The blade support 98 includes two telescopically interfitting hollow bars of rectangular cross section, designated 110 and 112 respectively, which may be extended and retracted to position the blade 96 in a front to rear direction. As illustrated in FIG. 5, bars 110 and 112 each have a plurality of holes in them which may be aligned to receive a pin 114 and fix the relative positions of the bars. The blade 96 may be adjusted in a front to rear direction of the frame 12 by removing the pins 114 and realigning the holes in the bars 110, 112.

As shown in FIG. 2, the forwardly facing surface 100 of the blade 96 is rearwardly swept from its center to its laterally outer ends 99 in a "V" shape so that as the tiles T are lifted from the floor, they are also guided toward the sides and out from under the frame 12 to be picked up. The blade 96 includes a base 118 attached by bolts 120 to the bar 110.

Figure 6:
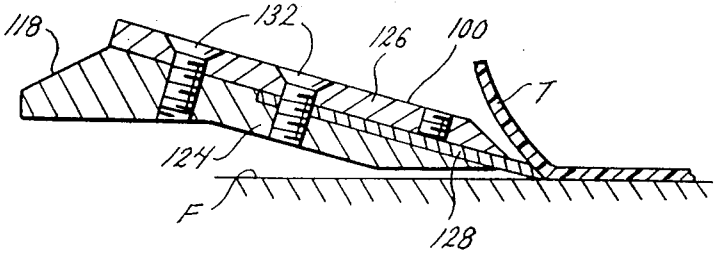
FIG. 6 is a cross section of the blade taken along line 6—6 of FIG. 2.

The rear portion 122 of the base 118 (which is attached to bar 110) is recessed from the surface 100 of the blade 96 and the front portion 124 of the base so that tile lifted from the floor by the blade will not engage the blade support 98 and jam under the frame 12. The blade 96 further includes a pair of clamping members 126, and a pair of blade inserts 128. As may be seen in FIG. 6, the blade inserts 128 are relatively thin replaceable plates which come to a point at their forwardmost edges for wedging between the relatively small space between the tile and the floor. The blade inserts 128 are clamped onto the front portion 124 of the base 118 by respective clamping members 126 which are attached to the base by fasteners 132. This allows the blade inserts 128 to be replaced if they become damaged or dulled by wear. The top surfaces of the clamping members 126 form the top surface 100 of the blade 96.

In operation, the blade 96 may be positioned according to the contour of the floor and type of tile being removed by adjusting the connections of the blade support 98 with the frame 12 and the telescopically interfitting bars, 110, 112. The process for lighting the burners 42 begins by opening the valve 62 at the tank outlet 60 to allow gas to flow to the first and second manifolds 70, 72 and into the second tubing 78. The flow of gas through the second tubing 78 to the burners 42 is halted at the valve assembly 80. The pilot 44 of each burner unit 40 may be lit by depressing button 82 on each manifold, which allows gas to flow to the pilot, and igniting the stream of gas at the pilot. Gas will flow to the pilot 44 so long as the thermocouple 54 senses heat generated by the pilot. If the thermocouple does not sense heat, then the gas flow to the pilots 44 is interrupted. The operator may then begin the tile removing procedure by moving the lever 88 of the valve assembly 80 to its second position which feeds gas to the burners 42 where it is ignited by the pilots 44. Should the operator release the hand grips and lever 88, the valve assembly 80 will shut-off the burners 42.

The center of the blade 96 is preferably aligned with a seam between tiles. As heat is applied to the tile and mastic below it, the mastic softens and, as illustrated in FIG. 1, the edge of the heated tiles T curl up away from the floor F. The frame 12 is then rolled forward and the blade members 128 wedge between the narrow space between the upturned edge of two or more tiles under the burner 42. As the blades are moved forwardly against the tiles, the tiles are lifted from the floor. After separation from the floor, the tiles are guided outwardly from under the frame 12 by the rearward sweep of the blade 96.

It may be seen that apparatus for use in removing tiles from a floor constructed according to the principles of the present invention is self-contained and therefore mobile because it is free of an umbilical connected to a remote energy source. Lacking a cord or other connection to a remote power source, the apparatus is conveniently operated because there is no risk of damaging the cord or fouling it in the mastic. The apparatus both loosens and removes tile from a floor, making the removal faster and requiring less labor. Tile can be removed by a single operator who can remain at the back of the frame away from the burners.

"It is to be understood that apparatus constructed according to the present invention may include the heater means 32 and the tank 34 (or other energy supply) self-contained on board the frame 12, as described above, without provision of any wedging means. Further, apparatus constructed according to the principles of the present invention may include the wedging means 94 and a heater means not necessarily having an energy supply self-contained on the frame 12, such as the type disclosed in U.S. Pat. No. 3,400,244, which is connected to its energy supply (electricity) remote from the frame."

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for use in removing tile from a floor, the apparatus comprising, a generally horizontally extending frame having a front end, a rear end and laterally opposing sides, roller means attached to the frame for rolling the frame across the floor, a handle mounted on the frame for steering the frame across the floor, heater means mounted on the frame for heating tiles below said heater means to loosen the tiles from mastic adhering the tiles to the floor, a tank mounted on the frame for storing fuel for said heater means, and conduit means for delivering the fuel from the tank to said heater means, whereby the apparatus is mobile and self-contained such that it may be moved about the floor for use in removing tile therefrom without connection to an energy supply remote from the apparatus.

2. Apparatus as set forth in claim 1 wherein said heater means comprises at least one gas burner unit.

3. Apparatus as set forth in claim 2 wherein each burner unit comprises a pilot and a burner, and wherein said conduit means comprises manifold means connected to the tank, first tubing extending from said manifold means to the pilot and second tubing extending from said manifold means to the burner.

4. Apparatus as set forth in claim 3 further comprising control means for controlling the flow of gas from the tank to the burner unit, said control means comprising a valve assembly interconnected with said second tubing, the valve assembly including means for actuating the valve assembly to control the flow of gas from the tank to the burner.

5. Apparatus as set forth in claim 4 wherein the handle is mounted on the rear end of the frame and projects generally rearwardly and upwardly therefrom, the handle having hand grips located generally at its distal end, and wherein said valve actuating means is mounted on the handle generally adjacent the hand grips for manipulation without releasing the hand grips.

6. Apparatus as set forth in claim 5 wherein said valve actuating means comprises a lever adapted to move from a first position in which the valve assembly stops the flow of gas from the tank to the burner to a second position in which the valve assembly permits fuel to flow from the tank to the burner, the lever being biased toward said first position.

7. Apparatus as set forth in claim 2 further comprising means mounted on the frame for wedging between the floor and the tiles loosened from the mastic by the burner unit for separating the tiles from the floor as the frame is moved across the floor.

8. Apparatus as set forth in claim 7 wherein said wedging means comprises a generally laterally extending blade disposed rearwardly of the burner unit, the blade having laterally outer ends and a generally forwardly facing inclined surface for wedging between the tiles and the floor, and a blade support attaching the blade to the frame, the blade support being adapted to adjustably position the blade in a front to rear direction and in a vertical direction relative to the frame.

9. Apparatus as set forth in claim 8 wherein the blade support has a sliding connection with the frame for adjusting the vertical position of the blade, the blade support comprising telescopically interfitting bars adapted to be extended and retracted relative to each other for adjusting the position of the blade in a front to rear direction.

10. Apparatus as set forth in claim 8 wherein the forwardly facing inclined surface of the blade is swept rearwardly generally from its center to each of its laterally outer ends for guiding tiles separated from the floor toward the sides of the frame and out from under the frame for pick-up.

11. Apparatus as set forth in claim 1 wherein said heater means is an infrared gas burner unit.

12. Apparatus for use in removing tile from a floor, the apparatus comprising, a generally horizontally extending frame having a front end, a rear end and laterally opposing sides, roller means attached to the frame for rolling the frame across the floor, heater means mounted on the frame for heating the tiles below said heater means to loosen the tiles from mastic adhering the tiles to the floor, and means mounted on the frame behind the heater means for wedging between the floor and the tiles loosened from the mastic by said heater means to separate the tiles from the floor as the frame is moved across the floor.

13. Apparatus as set forth in claim 12 wherein said wedging means comprises a generally laterally extending blade disposed rearwardly of said heater means, the blade having laterally outer ends and a generally forwardly facing inclined surface for wedging between the tiles and the floor, and a blade support mounting the blade to the frame, the blade support being adapted to adjustably position the blade in a front to rear direction and in a vertical direction relative to the frame.

14. Apparatus as set forth in claim 13 wherein the blade support has a sliding connection with the frame for adjusting the vertical Position of the blade, the blade support comprising telescopically interfitting bars adapted to be extended and retracted relative to each other for adjusting the position of the blade in a front to rear direction.

15. Apparatus as set forth in claim 13 wherein the forwardly facing inclined surface of the blade is swept rearwardly generally from its center to each of its laterally outer edges for guiding tiles separated from the floor toward the sides of the frame and out from under the frame for pick-up.

16. Apparatus as set forth in claim 15 further comprising a tank mounted on the frame for storing gas therein, and conduit means for delivery of the gas to said heater means whereby the apparatus is mobile and self-contained such that it may be moved about the floor to remove tile therefrom without connection to an energy supply remote from the apparatus.

17. Apparatus as set forth in claim 16 wherein said heater means comprises at least one gas burner unit including a pilot and a burner and wherein said conduit means comprises manifold means connect to the tank, first tubing extending from said manifold means to the pilot and second tubing extending from said manifold means to the burner.

18. Apparatus as set forth in claim 17 further comprising means for controlling the flow of gas from the tank to the burner, said control means comprising a valve assembly interconnected with said second tubing, the valve assembly including means for actuating the valve assembly to control the flow of gas from the tank to the burner.

19. Apparatus as set forth in claim 18 further comprising a handle mounted on the rear end of the frame and projecting generally rearwardly and upwardly therefrom, the handle having hand grips located at its distal end, and wherein said valve actuating means is mounted on the handle generally adjacent the hand grips for manipulation without releasing the hand grips.

20. Apparatus for use in removing tile from a floor, the apparatus comprising, a generally horizontally extending frame having a front end, a rear end and opposing sides, roller means attached to the frame for rolling the frame across the floor, a handle for steering the frame across the floor, the handle being mounted on the rear end of the frame and projecting generally rearwardly and upwardly therefrom, the handle having hand grips located at its distal end, at least one infrared gas burner unit mounted on the frame for heating tiles generally located under the burner unit to loosen the tiles from mastic adhering the tiles to the floor, each gas burner unit comprising a pilot and a burner, a tank for storing gas for the burner unit, conduit means for delivering the gas from the tank to the burner unit, and a valve assembly interconnected with said conduit means, the valve assembly including a means for actuating the valve assembly to control the flow of gas from the tank to the burner of the burner unit, said valve actuating means being mounted on the handle generally adjacent the hand grips, the valve actuating means comprising a lever movable from a first position in which the valve assembly stops the flow of gas from the tank to the burner to a second position in which the valve assembly allows flow of gas from the tank to the burner, the lever being biased toward said first position.

* * * * *